US007128658B2

(12) United States Patent
DuFour

(10) Patent No.: US 7,128,658 B2
(45) Date of Patent: Oct. 31, 2006

(54) SPORTS TRAINING DEVICE AND METHOD

(76) Inventor: Dave A. DuFour, 990 Highland Dr., Suite 202, Solana Beach, CA (US) 92075-2427

( * ) Notice: Subject to any disclaimer, the term of this patent is extended or adjusted under 35 U.S.C. 154(b) by 0 days.

(21) Appl. No.: 11/054,791

(22) Filed: Feb. 9, 2005

(65) Prior Publication Data

US 2006/0178224 A1 Aug. 10, 2006

(51) Int. Cl.
*A63B 69/36* (2006.01)

(52) U.S. Cl. ..... 473/276; 473/207; 473/212; 473/226

(58) Field of Classification Search ..... 473/212–219, 473/226, 227, 207, 276; 273/DIG. 21
See application file for complete search history.

(56) References Cited

U.S. PATENT DOCUMENTS

| | | | | |
|---|---|---|---|---|
| 1,699,219 | A | 1/1929 | Bemish et al. | |
| 3,595,583 | A * | 7/1971 | Oppenheimer | 473/215 |
| 3,937,465 | A * | 2/1976 | Roland | 473/461 |
| 4,030,732 | A * | 6/1977 | Vincent | 473/464 |
| 4,582,325 | A * | 4/1986 | Yuhara | 473/215 |
| 4,662,640 | A * | 5/1987 | Grander | 473/215 |
| 4,960,280 | A | 10/1990 | Corder, Jr. | |
| 5,150,901 | A | 9/1992 | Stawicki | |
| 5,154,416 | A | 10/1992 | Smull et al. | |
| 5,174,575 | A | 12/1992 | Leith et al. | |
| 5,295,690 | A | 3/1994 | Johnson | |
| 5,348,292 | A | 9/1994 | Norman, Sr. | |
| 5,375,836 | A | 12/1994 | Kiser | |
| 5,441,271 | A * | 8/1995 | Briggs | 473/215 |
| 6,196,931 | B1 | 3/2001 | Wilt | |
| 6,514,163 | B1 | 2/2003 | Burns | |
| 6,645,093 | B1 | 11/2003 | Sheppard | |
| 6,773,366 | B1 | 8/2004 | Gray | |

FOREIGN PATENT DOCUMENTS

| | | | |
|---|---|---|---|
| GB | 2367503 | A | 4/2002 |
| WO | WO03/080194 | A1 | 10/2003 |

OTHER PUBLICATIONS

Four Magic Moves to Winning Golf by Joe Dante; pp. 83-87, pp. 95-107, and pp. 121-122 Doubleday Dell Publishing Group, New York, NY 1995.

* cited by examiner

*Primary Examiner*—Nini F. Legesse
(74) *Attorney, Agent, or Firm*—Gordon & Rees, LLP

(57) ABSTRACT

A ball hitting training device has a ball hitting implement such as a baseball bat or golf club, a shoulder harness or anchoring device for wearing on a player's leading shoulder when taking a swing with the hitting implement, and an elongate tether of flexible, non-extensible material having a first end secured to the shoulder harness and a second end secured to a location at or adjacent the ball striking end of the hitting implement. By maintaining the tether taut during a practice swing, the player can establish a so-called magic triangle between the hands, the ball hitting end of the hitting implement, and the leading shoulder, and can maintain this triangular relationship throughout the swing.

10 Claims, 6 Drawing Sheets

SPORTS TRAINING DEVICE AND METHOD

BACKGROUND OF THE INVENTION

The present invention relates generally to sports training device and method, and is particularly concerned with a device for use in hitting practice in sports where a club, bat or other ball hitting implement is swung to hit a ball or other object.

One well known problem in swinging a bat or club to hit a ball in sports like baseball or golf is that of hitting the ball from the top or hitting the ball too soon, so that it will not travel as far. In other words, for an ideal swing, no effort should be made to move the hands, wrists, or arms to make the club or bat move. Instead, the movement of the club or bat should result from the player turning their-shoulders and the hands should move with the club or bat, i.e. not faster or slower than the bat.

Many publications on ideal golf or baseball swings refer to the so-called "Magic Triangle" or "Eternal Triangle". This is a triangle formed by the player's leading arm, the golf club or baseball bat, and an imaginary line between the player's leading shoulder to the approximate hitting end of the bat or golf club. For optimum results, this triangle should be maintained from the top of the swing almost up to the hitting area. This will produce a high speed impact with the ball, as described in detail in the book *Four Magic Moves to Winning Golf* by Joe Dante, pages 102 to 110, Doubleday, New York, 1995. This is a result of the conservation of angular momentum, which is the principle that the angular momentum of an object remains constant as long as no external force or moment acts on that object. The equation defining angular momentum is:

angular momentum=mass×velocity×distance (from point object is spinning or orbiting around).

In other words, when an object rotates around a fixed axis (when hitting a ball, this is the vertical axis of the player rotating to hit the bill), it rotates at a constant velocity as long as the object remains at the same distance from the axis. If the object is brought closer to the axis, it speeds up. If it is moved farther out, it slows down. In a golf swing, as the player rotates the club, the hands move farther from the body or axis and slow down. This reduction in momentum feeds into the much lighter club and increases the speed of the club head in the last part of the stroke, in a whiplash type of effect, increasing the force of impact on the ball. If the player speeds up their hands in an attempt to catch up with the club, this effect will be lost, reducing the distance that the ball will travel.

Although this effect has been understood in the golfing field for many years, it is very difficult for a beginning or average player to achieve. This is because there is an instinctive desire to manipulate the club in order to make the club head go faster. Even though the player has been told not to move his or her hands or snap his or her wrists in an attempt to speed up the club head during the latter part of the swing, it is very difficult to restrain the impulse to do just that, resulting in hitting the ball too soon or hitting from the top.

Many training devices have been proposed in the past in order to improve a golfer's or baseball player's swing, with limited success. One is simply to strap one or both arms to the player's body, so as to limit arm movement. Such devices are described, for example, in U.S. Pat. No. 4,960,280 of Corder, Jr., U.S. Pat. No. 5,154,416 of Smull et al., and U.S. Pat. No. 5,295,690 of Johnson. U.S. Pat. No. 5,174,575 of Leith et al. describes a device for tethering the golf club to the wearer's arm, to ensure that the golfer's wrists will pass through the plane of impact before the club head strikes the ball.

The principle and advantages of the delayed hit or late release are well known in the golfing and baseball field, as are the disadvantages of casting, hitting from the top, or early release, in which a player releases their stored energy too early in the swing. Although these principles are well known in the ball hitting field, up to now there has been no simple and effective device for training players in the proper stance and swing positioning for achieving the delayed hit or late release.

SUMMARY OF THE INVENTION

It is an object of the present invention to provide a new and improved training device for training players in order to improve their swing and ball hitting skills.

According to one aspect of the present invention, a training device for sports such as golf or baseball is provided, which comprises a hitting implement for hitting a ball, the hitting implement having a handle end and a ball striking end, a shoulder harness or anchoring device for wearing on a player's leading shoulder, and an elongate tether of flexible, non-extensible material secured at one end to the shoulder harness and secured at the opposite end to a location at or adjacent the ball striking end of the hitting implement.

The tether may be adjustable in length. The player will first adopt the proper starting position for a golf or baseball swing, with the tether adjusted in length until it is taut. In this position, a so-called magic or eternal triangle will be defined in which the three sides of the triangle comprise the player's leading arm (left arm for a right handed player and right arm for a left handed player), the hitting implement such as a golf club or baseball bat, and the line or tether connecting the leading shoulder to the approximate hitting end of the hitting implement. The player must then make the swing while maintaining the tether taut, thus maintaining the magic triangle throughout the practice swing. By repeatedly making swings using the training device, the player will develop "muscle memory" to help them maintain this positioning in a real swing at a ball. This will train the player in the proper body, club and hand positioning when approaching the ball, and help to resist the natural tendency to break or snap the wrists too early. The device also educates the player in the importance of the magic triangle relationship between their shoulder, hand, and the hitting end of the club or bat.

In an exemplary embodiment of the invention, the tether is secured at one end to the upper region of the shoulder harness, corresponding to the top of the player's shoulder when the harness is worn, by any suitable fastener mechanism. In a golf practice version of the invention, the opposite end of the tether may be simply knotted around the hosel adjacent the club head, or may be secured around the hosel by a suitable clamp, clasp or buckle. In the baseball practice version, an eyelet or the like is secured to the practice bat adjacent the hitting end of the bat, and the end of the tether may be secured through the eyelet. In either version, the tether, which may be a rope, strap, or other type of line, is adjustably secured at one end via a suitable adjustable fastener device, such as a cam cleat of the type used in sailing, an adjustable rope clamp, a buckle, releasable hook and loop fastener material, or any other adjustable fastener through which the end of the tether extends.

According to another aspect of the invention, a ball hitting practice method is provided, which comprises the steps of:

securing one end of a flexible, inextensible tether to a shoulder harness;

securing the opposite end of the tether to a hitting implement at or adjacent the ball hitting end of the implement;

securing the shoulder harness to the leading shoulder of a player undergoing training;

adjusting the length of the tether between the leading shoulder and hitting end of the hitting implement when the player has adopted the starting position for a swing at a ball, such that the tether is taut; and the player maintaining the tether in a taut condition while performing a swing in preparation for hitting a ball.

With this method, the player undergoing training can be taught to maintain the magic triangle relationship between their leading shoulder, their hands, and the hitting end of the ball hitting element for as long as possible during the swing. This can result in a significant improvement in ball hitting skills in a relatively short time period. The player will develop so-called "muscle memory" if they repeat the swinging movement many times using the training device, which can counteract the natural tendency to snap the wrists too early in the swing.

The swing training device and method of this invention is particularly useful in training golf and baseball players in the ideal swing to hit the ball farther, and may also be used in any other sport where a ball or other object is hit with a hitting implement. It will be more effective than other known training devices since it can train the player in the importance of the so-called magic triangle and the effect of conservation of momentum, so that the stored up energy of the swing can be retained until the optimum point of release. The training device reminds the player to hold the wrists in the initial position for a longer time period during the swing, and to retain the same angle between the leading arm and the shaft of the club until the last possible instant before impact with the ball, producing a high speed impact with the ball and increasing the distance the ball will travel.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which.

DETAILED DESCRIPTION OF THE DRAWINGS

Figure 1:
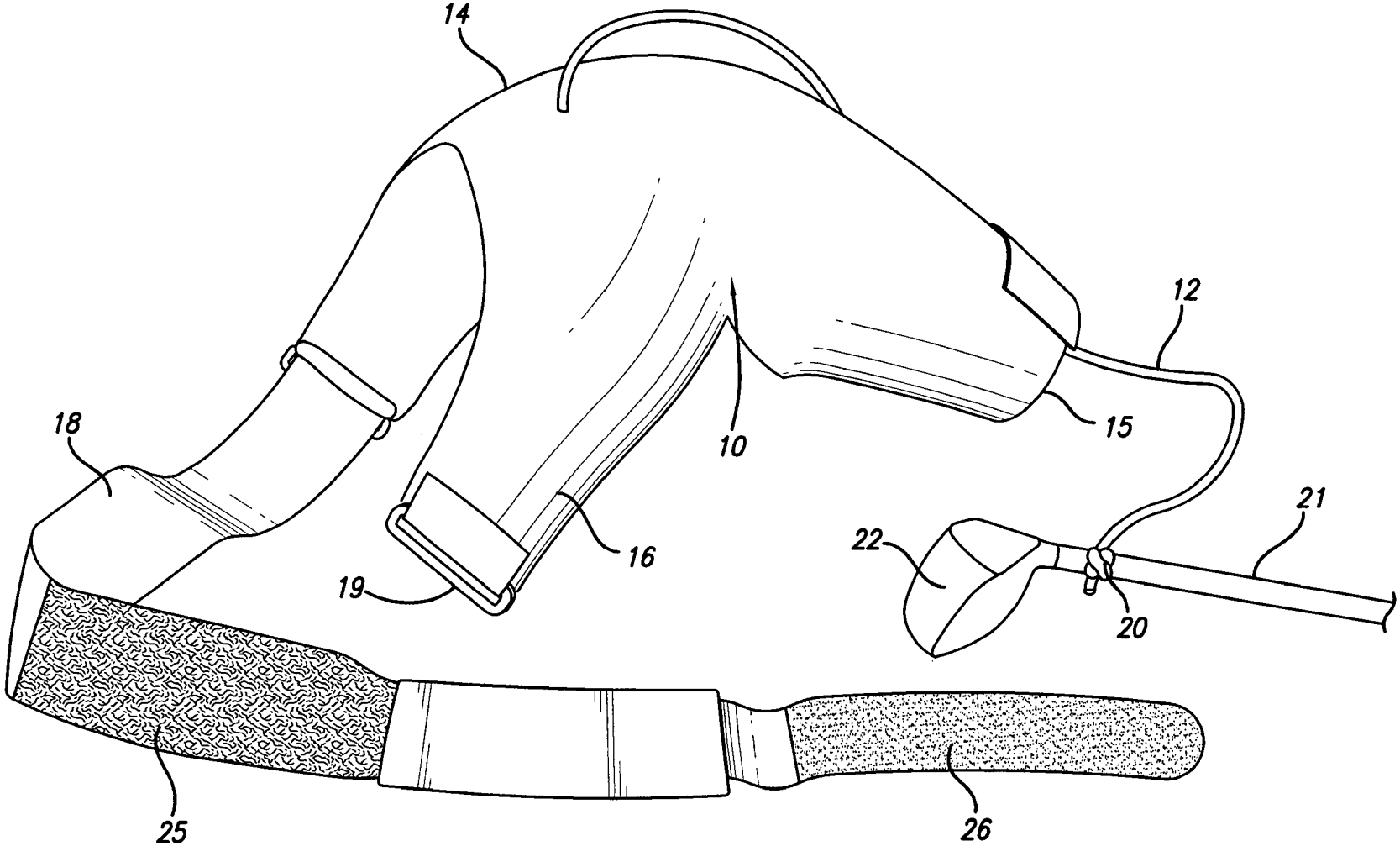
FIG. 1 is a front elevational view of a training device according to an exemplary embodiment of the invention attached to a golf club for training a golfer.

FIG. 1 illustrates a training device according to an exemplary embodiment of the present invention. The device can be used for training players in any sport where a hitting implement such as a club or bat is swung by a player in order to hit and propel a ball or other object. In FIG. 1, the device is shown attached to a golf club 21, but it may alternatively be attached to a baseball bat 23 as in FIG. 2, or to any other ball or object hitting implement used in sport.

The device basically comprises a shoulder harness 10 for securing to the leading shoulder of a player, and a tether 12 having a first end secured to the upper region 14 of the shoulder harness and a second end secured around the hosel 20 of the golf club adjacent the club head 22. The tether 12 is of any suitable flexible but non-extensible material, such as a rope, cord, strap, line or the like. The first end of the tether is secured to the shoulder harness at a location which will correspond to the top of the leading shoulder of the player when the harness is worn.

Any suitable shoulder harness or anchoring device for securing to a player's shoulder may be used. In the illustrated embodiment, the shoulder harness has a short sleeve portion 15 for engaging over the upper end of the user's arm, an open upper shoulder engaging portion 14, and first and second straps 16,18 for extending from the front and back of the shoulder, respectively. The longer, rear strap 18 extends under the user's opposite arm and through a loop or buckle 19 at the end of the shorter strap. Suitable fastener means such as opposing portions of hook and loop fastener material 25, 26 are provided on the strap 18 so as to secure the strap at a suitable tightness across the user's chest, as seen in FIGS. 6C and 7C. As noted above, this is just one possible example of a shoulder harness which may be used for the training device. Any suitable anchoring device for fastening about a user's shoulder in order to anchor the end of the tether may be used in place of the shoulder harness 10 in alternative embodiments, such as a simple strap fastened around the player's shoulder, or a different design of shoulder harness.

Figure 2:
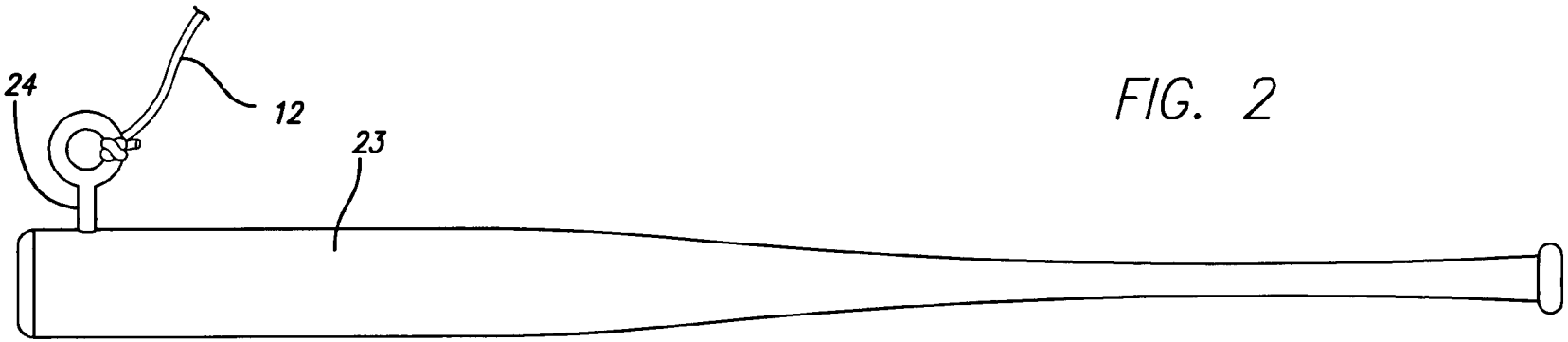
FIG. 2 is front elevational view of a baseball bat attached to the tether of the training device of FIG. 1 in an alternative, baseball training arrangement.

Any suitable fastener means may be used to secure the end of the tether 12 to the shoulder harness. In FIG. 1, the end of the tether extends through an opening in the harness and is knotted to secure it in position on the inside of the harness. The opposite end of the tether is also simply knotted around the hosel of the golf club in this embodiment. FIG. 2 illustrates an alternative arrangement where the second end of the tether is attached to a baseball bat 23 for baseball training. In this case, an eyelet 24 is secured to the bat 23 at the hitting end, and the tether is knotted through the eyelet.

Figure 3:
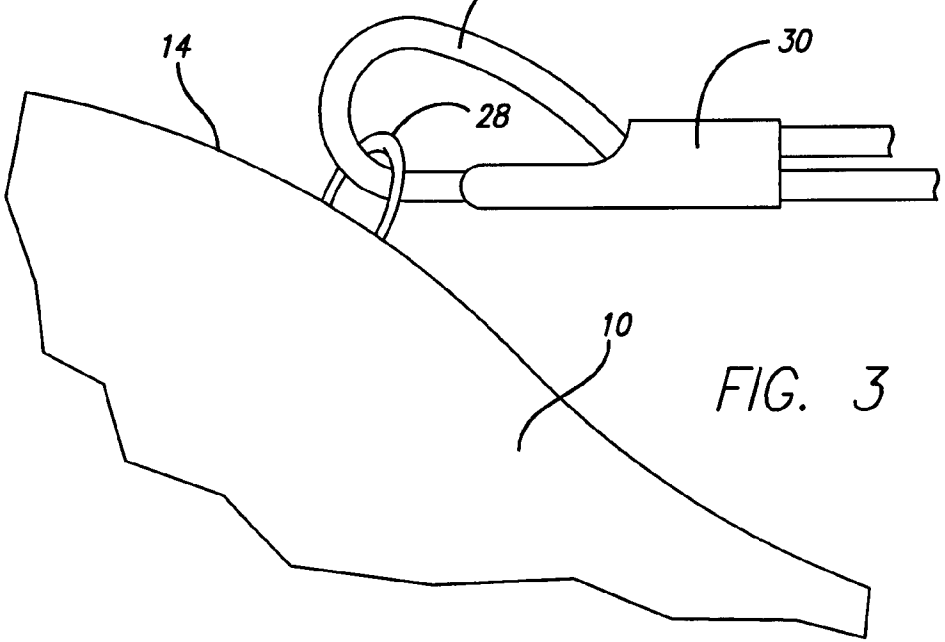
FIG. 3 illustrates an optional adjustable fastener device at the shoulder harness end of the tether of the training device of FIG. 1.
Figure 5:
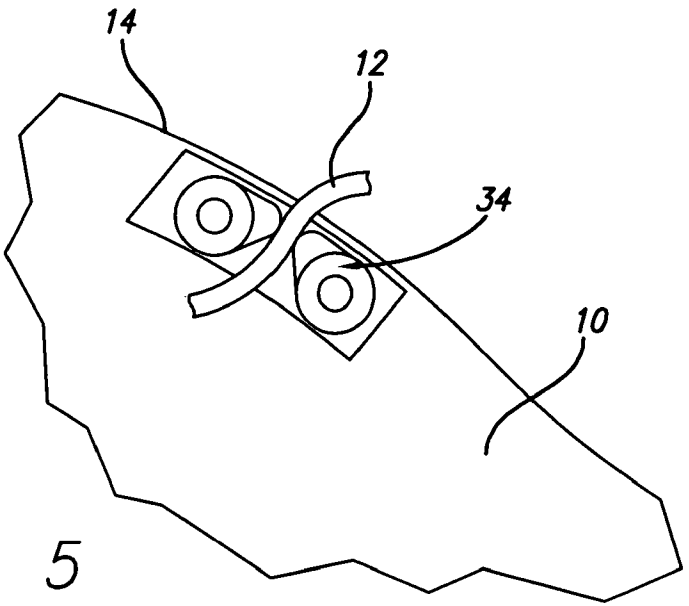
FIG. 5 illustrates an alternative adjustable fastener for the tether at the shoulder harness.

Although the tether may be simply knotted at each end to secure it to the shoulder harness and hitting implement, as in FIGS. 1 and 2, it may alternatively be secured at least at one end via an adjustable fastener device to allow the length of the tether to be readily adjusted for individual players with different body sizes and arm lengths. In FIG. 3, the first end of the tether 12 extends through an adjustable rope clamp 30, then through an eyelet 28 secured to the upper portion 14 of the shoulder harness 10, and then back through the rope clamp 30. This will permit the tether length between the shoulder harness and hitting implement to be readily adjusted simply by pulling the end of the tether or rope through clamp 30. The tether may also be secured via a rope clamp 32 at the hitting end of the baseball bat, as in FIG. 4, or at the head end of a golf club in a similar manner. In another alternative, as indicated in FIG. 5, the first end of the tether 12 extends through a cam cleat 34 attached to the upper region 14 of the shoulder harness. The cam cleat may be of the type generally used to secure ropes in sailing.

Figure 4:
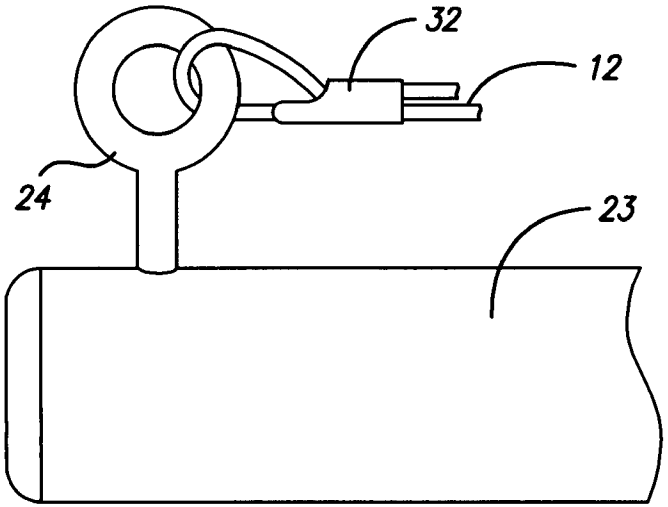
FIG. 4 illustrates an adjustable fastener device at the baseball bat end of the tether.

Any suitable adjustment device may be used to adjustably secure one end of the tether to the shoulder harness or the hitting implement, including the devices illustrated in FIGS. 3 to 5 or any other adjustable fastener through which the end of the tether extends. For example, the tether may comprise a strap which extends through a loop, rings or a buckle and is secured in any conventional manner.

Figure 6A:
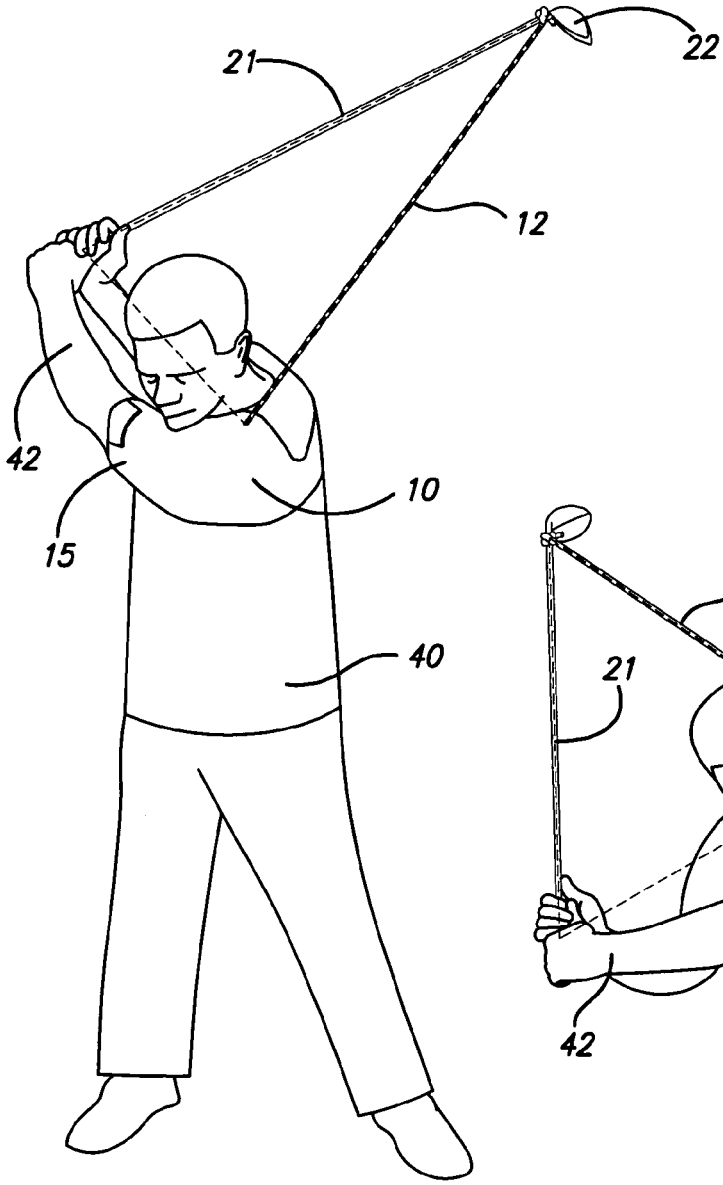
FIGS. 6A to 6C illustrate a golf player using the training device to practice a golf swing.
Figure 6B:
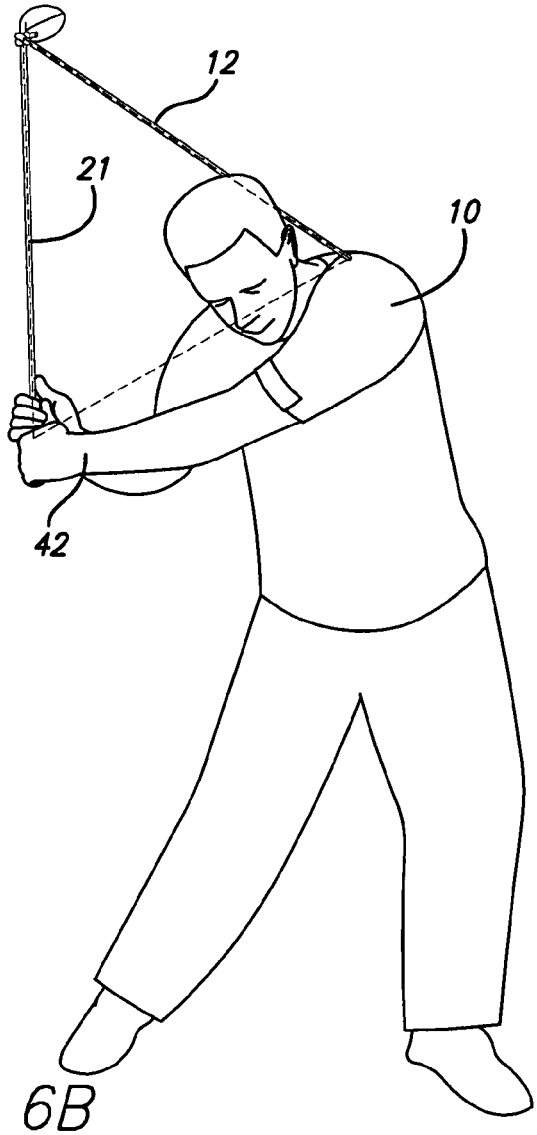
Figure 6C:
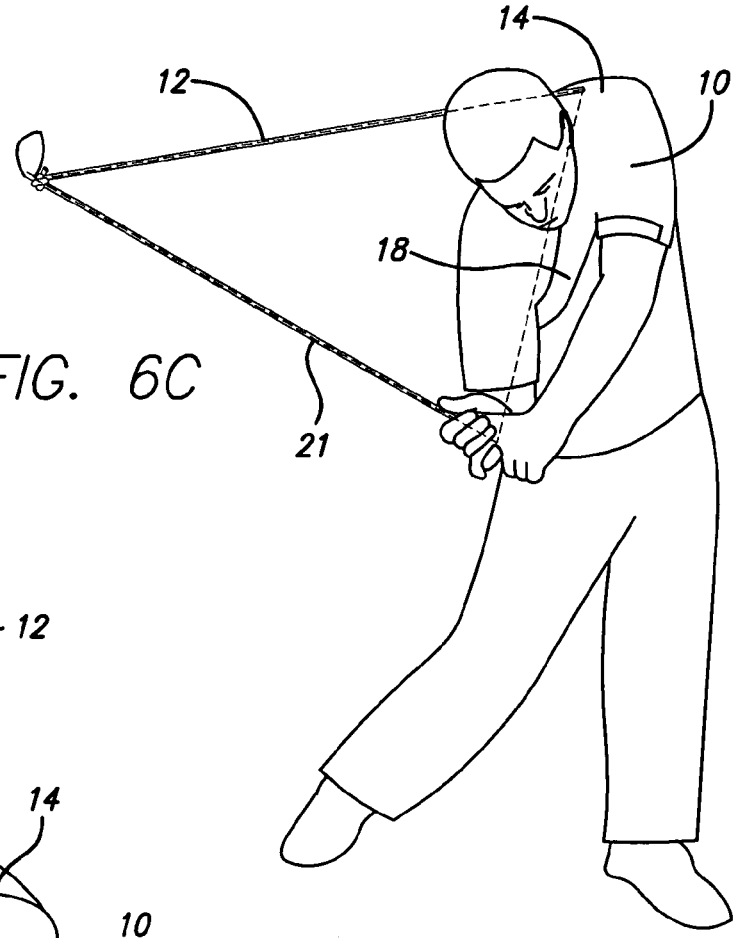
Figure 7A:
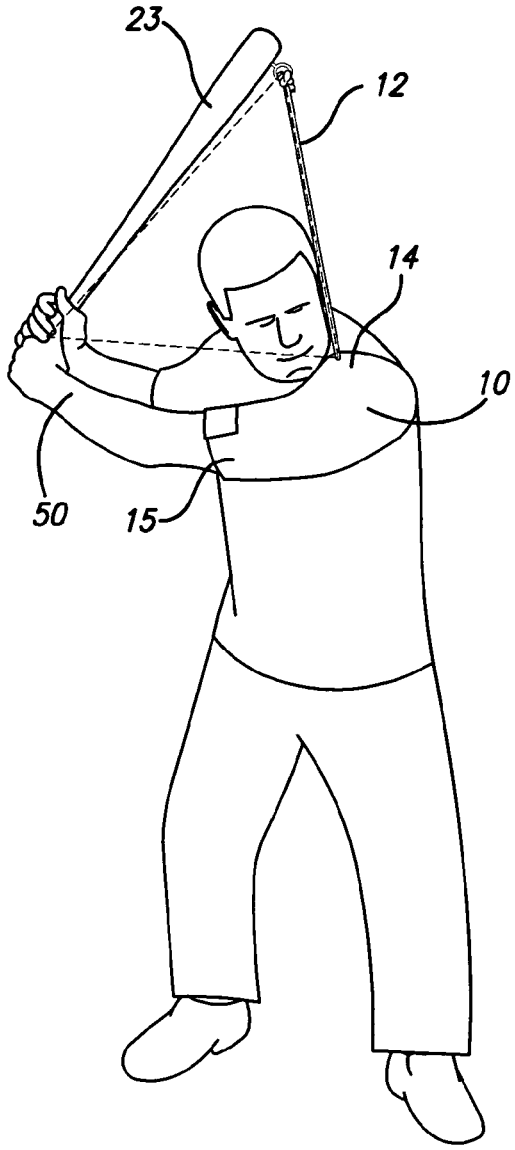
FIGS. 7A to 7C illustrate a baseball player using the training device to practice a baseball swing.
Figures 7B, 7C:
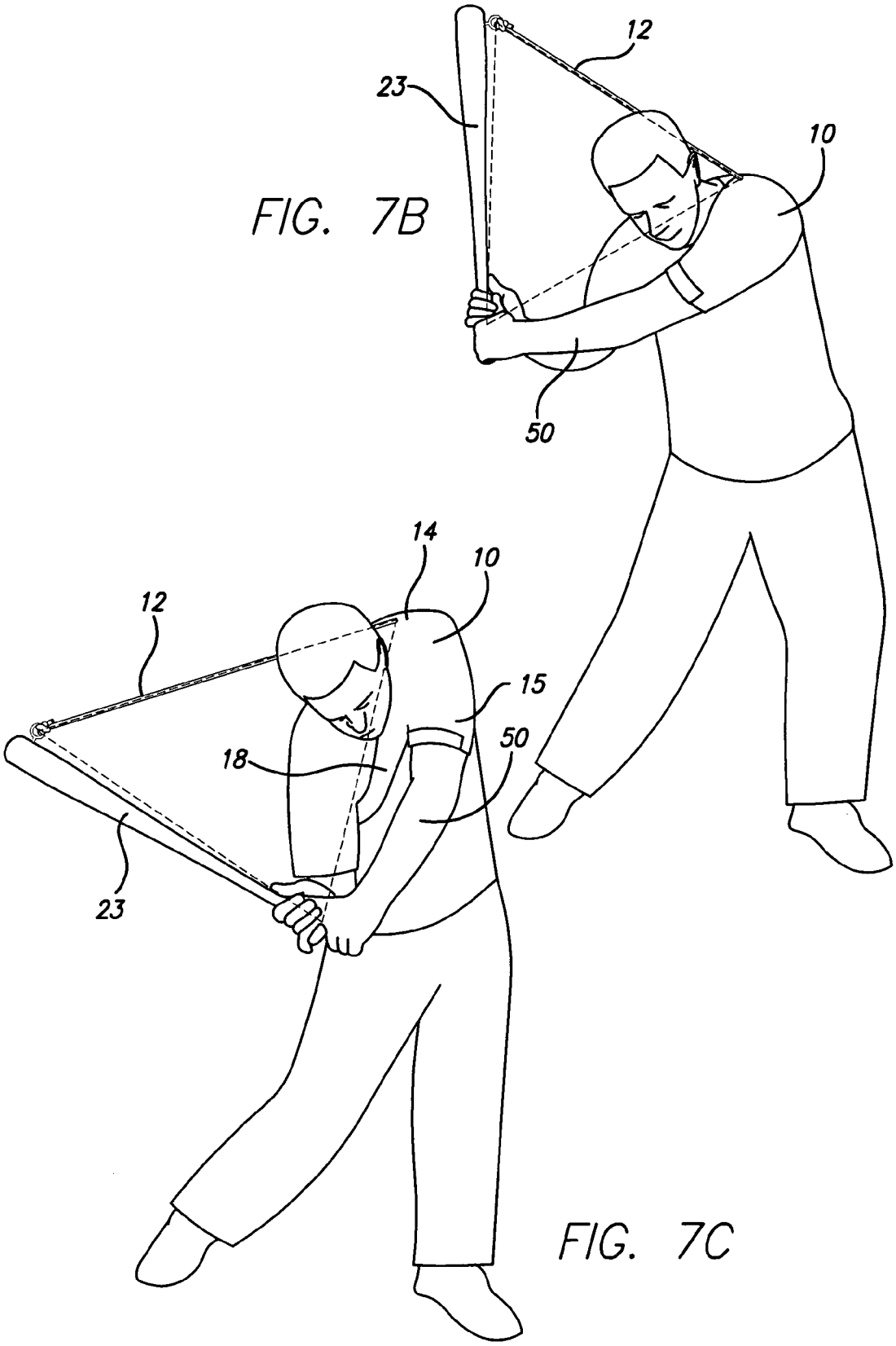

FIGS. 6A to 6C and 7A to 7C illustrate how the training device will be used for training a player in a golf or baseball swing, respectively. The golfer 40 will first engage and secure the shoulder harness about their leading shoulder, then grip the handle of the golf club 21 and adopt the starting position at the peak of their back swing, as in FIG. 6A. The trainer will then adjust the length of the tether 12 until it is taut. The tether length when taut will vary from player to player, dependent on arm length and the like, but may be of the order of 32 to 38 inches for a typical golfer. As indicated by the dotted lines in FIG. 6A, in this position a triangle is established in which the three sides of the triangle comprise the leading arm 42 of the player (this will be the left arm as illustrated in FIG. 6A for a right handed player, and the right arm for a left handed player), the golf club 21, and the line or tether 12 connecting the leading shoulder to the approximate hitting end of the golf club. This is the so called "magic triangle" which will produce optimum results if maintained throughout the swing almost up to the point of hitting the ball.

The player is instructed to keep the tether 12 taut throughout their practice swing. FIGS. 6B and 6C illustrate successive positions through the swing where the player makes a one half to two third swing. It can be seen that the triangle is maintained automatically if the player keeps the tether 12 taut. By repeating these movements over and over, the player is reminded to keep the wrists in the initial position for a longer time period during the swing, maintaining the magic or swing triangle throughout the early stages of the downswing and storing up energy to be released later as the ball is hit. Ideally, the player retains the same angle between the leading arm and the shaft of the club head until the last possible instant before the ball is hit, resulting in what is known as a late hit in which the club head suddenly catches up with the ball as the hands reach the ball. This produces a high speed impact with the ball so that it will travel farther.

While practicing, the player must make the swing while maintaining the tether taut, thus maintaining the magic triangle throughout the practice swing. By repeatedly making swings using the training device, the player will develop "muscle memory" to help them maintain this positioning in a real swing at a ball. This will train the player in the proper body, club and hand positioning when approaching the ball, and help to resist the natural tendency to break or snap the wrists too early. The device also educates the player in the importance of the magic triangle relationship between their shoulder, hand, and the hitting end of the golf club. It has been found that use of this practice device can significantly improve ball striking distance for a beginning or average golfer in a relatively short time period.

FIGS. 7A to 7C illustrate use of the training device for baseball hitting practice. Again, the player first engages the shoulder harness 10 on their leading shoulder. This will be the left shoulder for a right handed player and the right shoulder for a left handed player. They then adopt the starting position for a baseball swing, as illustrated in FIG. 7A for a right handed player. The trainer then adjusts the length of the tether 12 until it is taut. The tether length when taut will vary from player to player depending on arm length and body size, but will generally be of the order of 25 to 33 inches.

As in the golf practice example, it can be seen that a triangular relationship is established between the player's leading arm 50, the baseball bat 23, and the tether 12, as illustrated by the dotted lines in FIG. 7A. Again, for an ideal swing, this triangular relationship should be maintained for as long as possible during the swing, until the instant just before the ball is struck. FIGS. 7B and 7C illustrate successive positions during the baseball swing. It can be seen that the player can easily maintain the triangular relationship indicated by the dotted lines just by holding the tether 12 taut. By repeating the practice swing over and over using the training device, the player will be more aware of the magic triangle relationship and will be trained in the proper body, club and hand positioning when approaching the ball. As a result, the player will be more able to resist the natural tendency to break or snap the wrists too early when making a real swing at a ball. This should result in a considerable improvement in ball hitting skills.

The illustrated embodiments show the training device of this invention as used for training a golfer or baseball player in the ideal swing However, it may alternatively be used in any other sport involving hitting a ball with a ball striking implement, where maintaining a similar triangular relationship may be helpful, such as hockey or the like.

The training device of this invention will be more effective than other known ball hitting training devices since it can train the player in the importance of the so-called magic triangle and the effect of conservation of momentum, so that the stored up energy of the swing can be retained until the optimum point of release. The training device reminds the player to hold the wrists in the initial position for a longer time period during the swing, and to retain the same angle between the leading arm and the shaft of the club until the last possible instant before impact with the ball, producing a high speed impact with the ball and increasing the distance the ball will travel. With this training device and training method, the player undergoing training can be taught to maintain the magic triangle relationship between their leading shoulder, their hands, and the hitting end of the ball hitting element for as long as possible during the swing. This can result in a significant improvement in ball hitting skills in a relatively short time period. The player will develop so-called "muscle memory" if they repeat the swinging movement many times using the training device, which can counteract the natural tendency to snap the wrists too early in the swing.

Although some exemplary embodiments of the invention have been described above by way of example only, it will be understood by those skilled in the field that modifications may be made to the disclosed embodiments without departing from the scope of the invention, which is defined by the appended claims.

I claim:

1. A ball hitting training device, comprising:

a hitting implement for hitting a ball, the hitting implement having a handle end and a ball striking end;

a shoulder harness for wearing on a player's leading shoulder, the harness having an upper region for engaging the upper part of the player's shoulder when the harness is worn; and an elongate tether of flexible, non-extensible material having a first end secured directly to the upper region of the shoulder harness and a second end secured to a location at or adjacent the ball striking end of the hitting implement;

whereby when the harness is worn and the player adopts a starting position for swinging the hitting implement, a triangle will be formed in which the three sides of the triangle comprise the player's leading arm, the hitting element, and the tether extending from the upper region of player's shoulder to the location at or adjacent the ball striking end of the hitting implement, and wherein the tether extends across behind the player's head when the triangle is formed.

2. The device as claimed in claim 1, wherein the tether is adjustable in length.

3. The device as claimed in claim 2, further comprising an adjustable fastener device for securing the first end of the tether to the upper region of the shoulder harness, the fastener device comprising means for adjusting the length of the tether between the shoulder harness and ball striking end of the hitting implement.

4. The device as claimed in claim 1, further comprising an adjustable fastener device for securing the second end of the tether to the ball striking end of the hitting implement, the fastener device comprising means for adjusting the length of the tether between the shoulder harness and ball striking end of the hitting implement.

5. The device as claimed in claim 1, wherein the hitting implement comprises a golf club and the second end of the tether is secured to the hosel of the golf club adjacent the club head.

6. The device as claimed in claim 1, wherein the hitting implement comprises a baseball bat and the second end of the tether is secured to the hitting end of the baseball bat.

7. The device as claimed in claim 6, further comprising an eyelet secured to the hitting end of the baseball bat, the second end of the tether being secured through the eyelet.

8. The device as claimed in claim 1, wherein the tether comprises a rope.

9. A ball hitting practice method comprising the steps of:

securing a first end of a flexible, inextensible tether directly to an upper portion of a shoulder harness;

securing the opposite, second end of the tether to a hitting implement at or adjacent the ball hitting end of the implement;

securing the shoulder harness to the leading shoulder of a player undergoing training such that the first end of the tether is located at an upper region of the player's leading shoulder;

adjusting the length of the tether between the leading shoulder and hitting end of the hitting implement when the player has adopted the starting position for a swing at a ball, such that the tether is taut; and the player maintaining the tether in a taut condition while performing a swing in preparation for hitting a ball, whereby a triangle is formed having a first side comprising the player's leading arm up to the upper region of the leading shoulder, a second side comprising the ball hitting implement, and a third side comprising the tether extending between the upper region of the player's leading shoulder and the attachment point at or adjacent the hitting end of the hitting implement, and wherein the tether extends across behind the player's head when the triangle is formed.

10. A ball hitting training device, comprising:

a hitting implement for hitting a ball, the hitting implement having a handle end and a ball striking end;

an anchoring device for wearing by a player, the anchoring device having an attachment point adapted to be located at an upper region of a player's leading shoulder when the anchoring device is worn; and an elongate tether of flexible, non-extensible material having a first end secured directly to the attachment point of the anchoring device and a second end secured to a location at or adjacent the ball striking end of the hitting implement;

whereby when the anchoring device is worn and the player adopts a starting position for swinging the hitting implement, a triangle will be formed in which the three sides of the triangle comprise the player's leading arm, the hitting implement, and the tether extending from the upper region of player's shoulder to the location at or adjacent the ball striking end of the hitting implement, and wherein the tether extends across behind the player's head when the triangle is formed.

* * * * *